US007648398B1

(12) United States Patent
Liao et al.

(10) Patent No.: US 7,648,398 B1
(45) Date of Patent: Jan. 19, 2010

(54) MEMORY CARD CONNECTOR

(75) Inventors: Wei-Hong Liao, Tu-Cheng (TW); Ming-Chiang Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/292,871

(22) Filed: Nov. 28, 2008

(51) Int. Cl.
*H01R 13/648* (2006.01)

(52) U.S. Cl. ..... 439/630; 439/159

(58) Field of Classification Search ..... 439/630, 439/150, 160, 159
See application file for complete search history.

(56) References Cited

U.S. PATENT DOCUMENTS 7,309,245 B2 * 12/2007 Sadatoku et al. ..... 439/159
7,367,828 B2 * 5/2008 Matsukawa et al. ..... 439/160
2008/0050954 A1 * 2/2008 Maruyama ..... 439/155

* cited by examiner

*Primary Examiner*—Gary F. Paumen
(74) *Attorney, Agent, or Firm*—Rosenberg, Klein & Lee

(57) ABSTRACT

A memory card connector includes an insulating housing, a plurality of terminals and an ejection mechanism mounted to a side of the insulating housing. The insulating housing defines a receiving space for receiving a memory card and a plurality of terminal grooves for correspondingly receiving the terminals therein. The ejection mechanism includes a slider. The slider has a base body, a sliding body extending inward from a rear of the base body to be located in the receiving space, and an elongated locking body extending frontward from a root portion of the sliding body and spaced from a bottom wall of the insulating housing. A free end of the locking body is projected downward to form a projection for being buckled into a recess formed at a side of the memory card.

3 Claims, 6 Drawing Sheets

MEMORY CARD CONNECTOR

BACKGROUND OF THE INVENTION

1. Field of the Invention

The present invention relates to a memory card connector, and more particularly to a memory card connector capable of preventing a memory card from being overly ejected.

2. The Related Art

Card connectors are widely used in varied electronic products for receiving electronic cards which are capable of storing up data information. A conventional memory card connector adapted for receiving a memory card includes an insulating housing, a plurality of terminals received in the insulating housing, an ejector and a shielding shell encircling the insulating housing. The ejector is received in one side of the insulating housing for ejecting the memory card from the memory card connector.

However, the ejector of the conventional memory card connector has no fixtures to lock the memory card, so when the memory card is ejected from the memory card connector, the memory card would likely fall to the ground because the ejector overly drive it out from the memory card connector, which will cause a bad effect on the memory card.

SUMMARY OF THE INVENTION

An object of the present invention is to provide a memory card connector capable of preventing a memory card from being overly ejected. The memory card connector includes an insulating housing, a plurality of terminals and an ejection mechanism. The insulating housing defines a receiving space for receiving the memory card and a plurality of terminal grooves for correspondingly receiving the terminals therein. The ejection mechanism is mounted to one side of the insulating housing, including a slider. The slider has a base body, a sliding body extending inward from a rear of the base body to be located in the receiving space, and an elongated locking body extending frontward from a root portion of the sliding body and spaced from a bottom wall of the insulating housing. A free end of the locking body is projected downward to form a projection for being buckled into a recess formed at a side of the memory card.

As described above, when the memory card is inserted into the memory card connector, the locking body presses on the side of the memory card and the projection is buckled into the recess of the memory card, which locks the memory card to the memory card connector firmly. When the memory card is ejected from the memory card connector, the projection is engaged with the recess to retain the memory card partially in the memory card connector, which prevents the memory card from being overly ejected.

BRIEF DESCRIPTION OF THE DRAWINGS

The present invention will be apparent to those skilled in the art by reading the following description of an embodiment thereof, with reference to the attached drawings, in which.

DETAILED DESCRIPTION OF THE PREFERRED EMBODIMENT

Figure 1:
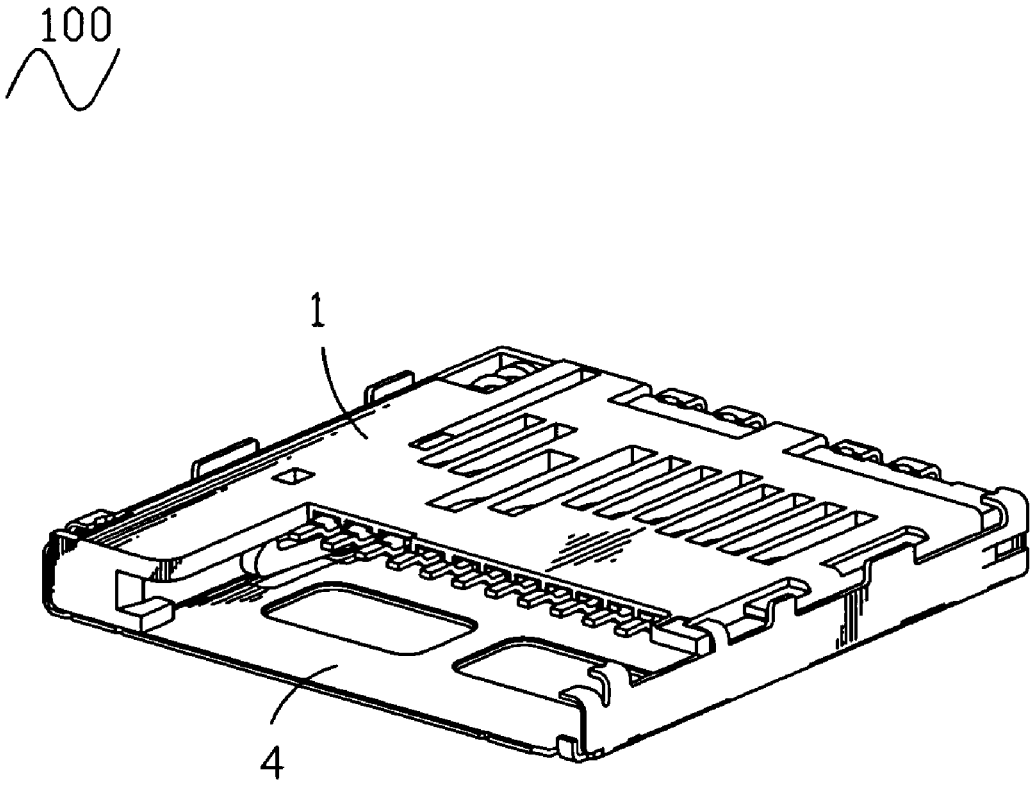
FIG. 1 is a perspective view of a memory card connector in accordance with the present invention.
Figure 2:
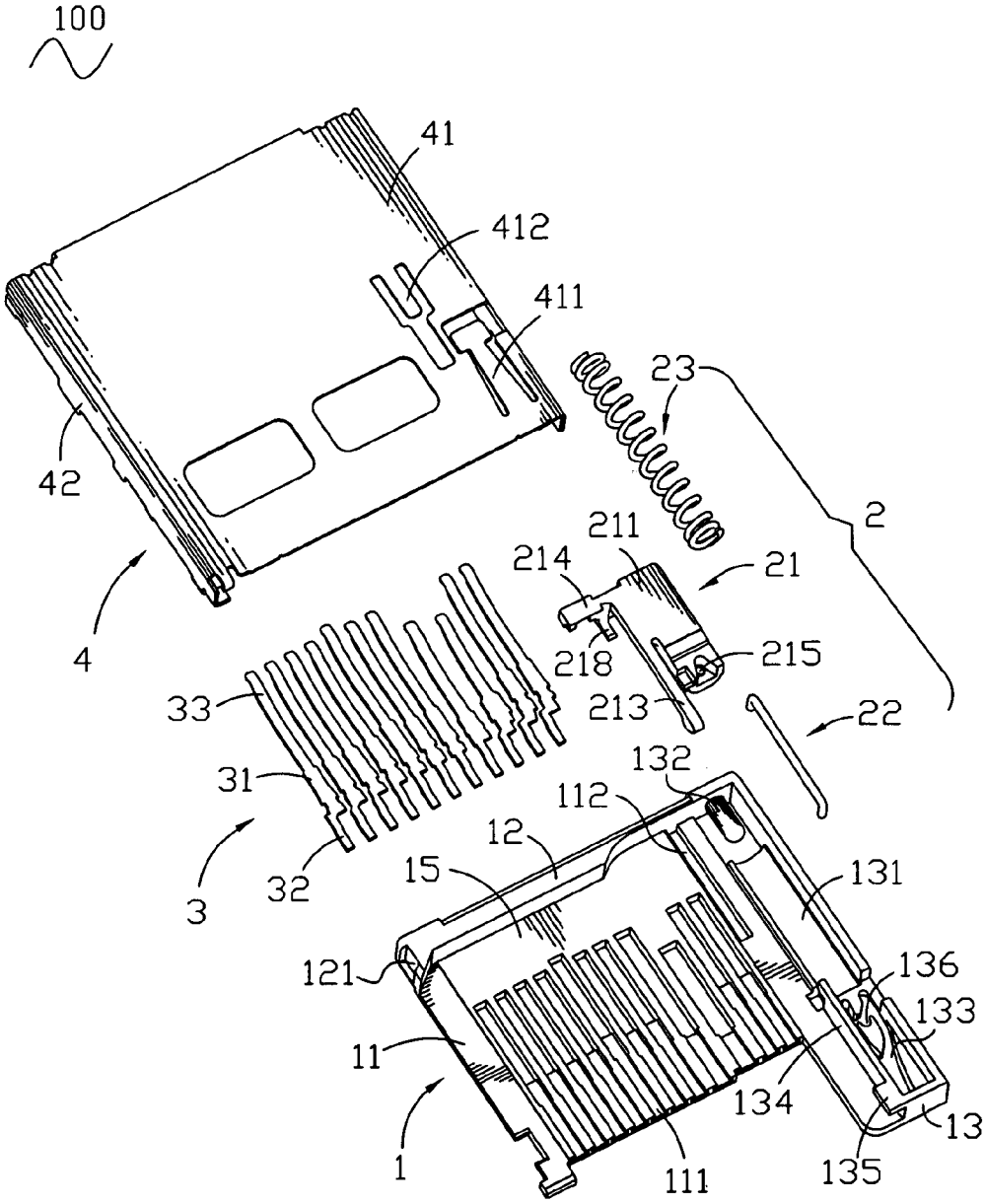
FIG. 2 is an exploded view of the memory card connector shown in FIG. 1.
Figure 3:
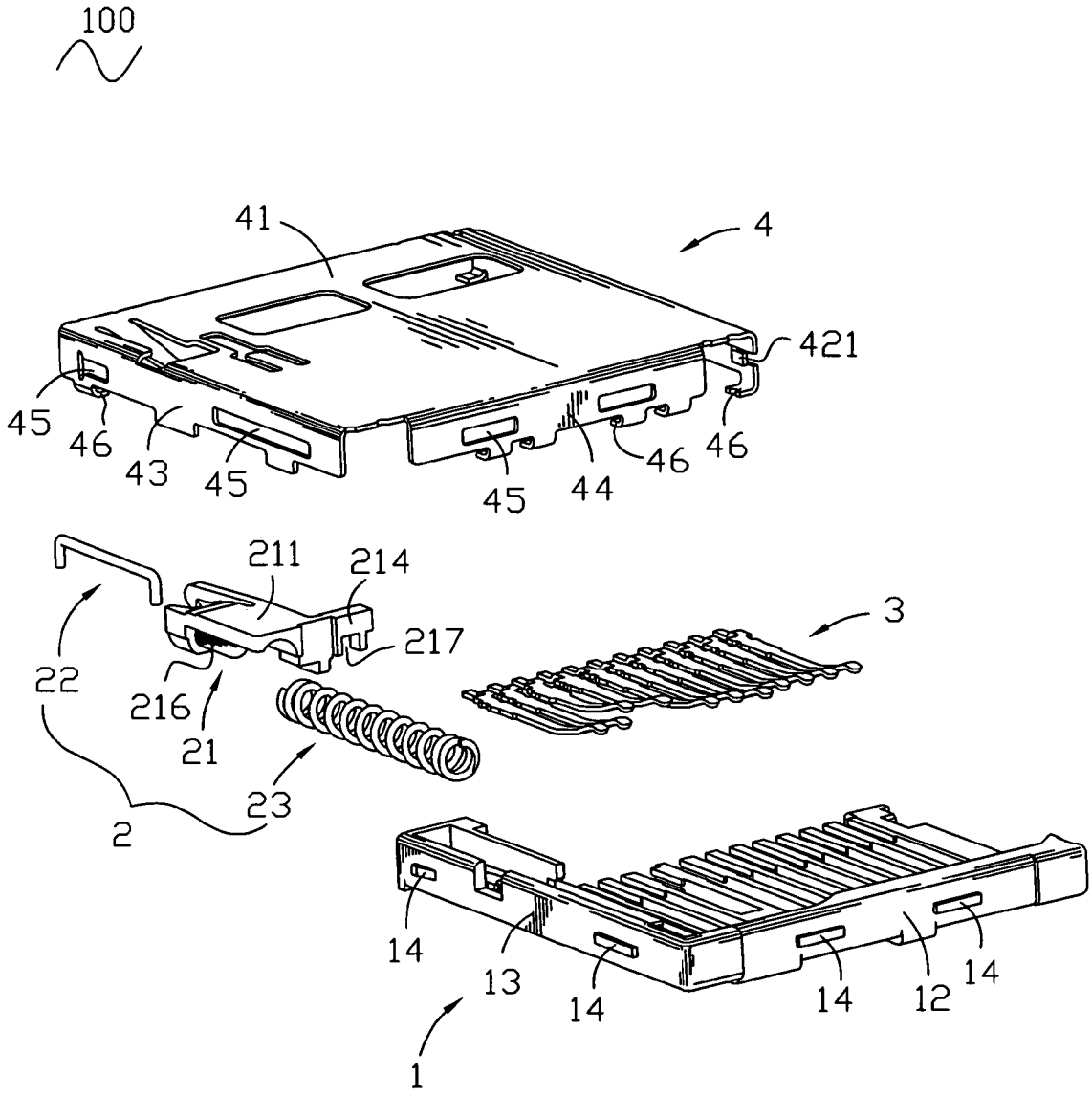
FIG. 3 is another angle exploded view of the memory card connector shown in FIG. 1.

With reference to FIGS. 1 to 3, which shows a memory card connector 100 in accordance with the present invention. The memory card connector 100 includes an insulating housing 1, an ejection mechanism 2, a plurality of terminals 3 received in the insulating housing 1, and a shielding shell 4 mated with the insulating housing 1.

Figure 5:
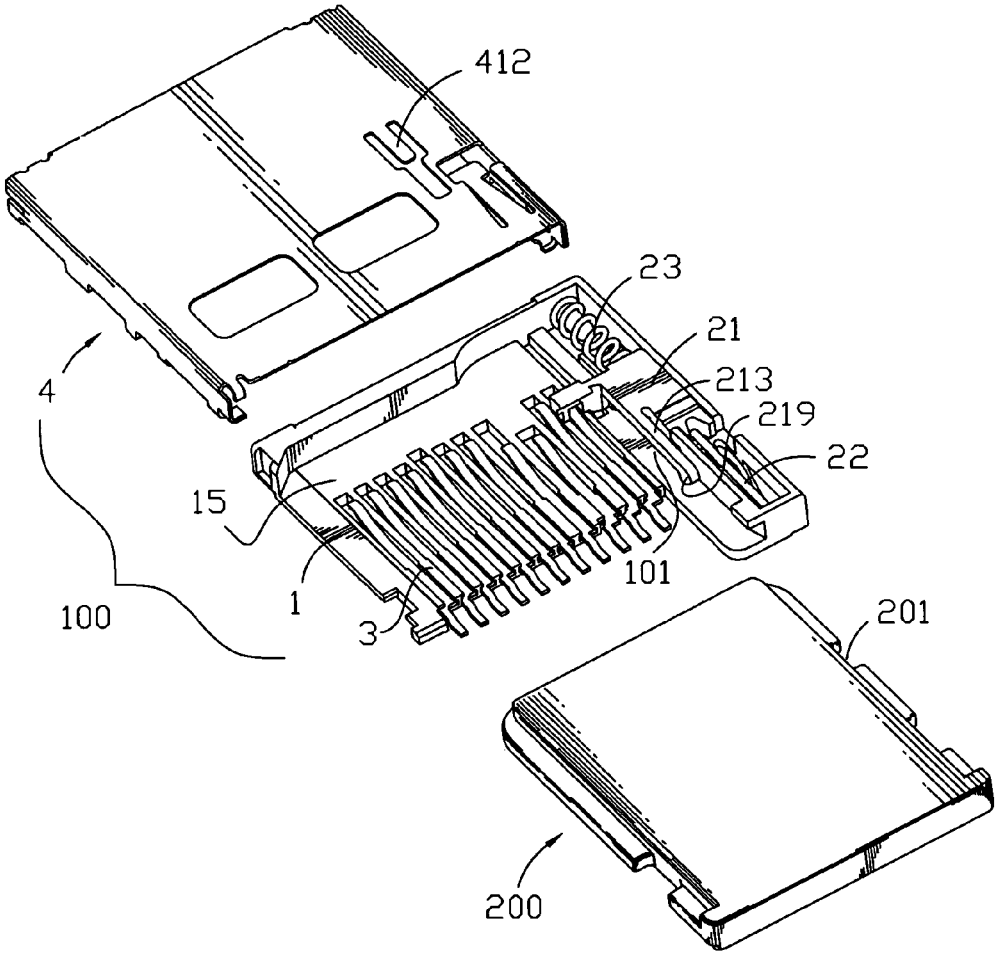
FIG. 5 is a partially assembly view of the memory card connector of FIG. 1 and a memory card before inserted into the memory card connector.

The insulating housing 1 has a bottom wall 11, a rear wall 12 extending upwardly from a rear of the bottom wall 11, a sidewall 13 extending upwardly from a side of the bottom wall 11 and connected with one end of the rear wall 12 to define a receiving space 15 therebetween for receiving a memory card 200 (as shown in FIG. 5). The other end of the rear wall 12 defines a notch 121. The bottom wall 11 defines a plurality of terminal grooves 111: for containing the terminals 3. A longitudinal through slot 112 is defined between the terminal grooves 111 and the sidewall 13 and located in a rear portion of the bottom wall 11. Both of the rear wall 12 and the sidewall 13 define two protruding lumps 14 projecting outside.

A rear portion of the sidewall 13 defines a receiving trough 131 communicated with the receiving space 15. The receiving trough 131 has an arc-shaped bottom. A holding pillar 132 projects forward from a rear surface of the receiving trough 131. A front portion of the sidewall 13 defines a substantially heart-shaped guiding slot 133 adjacent to the receiving trough 131 and separated from the receiving space 15 by a partition 134. The receiving trough 131 and the heart-shaped guiding slot 133 combine together for receiving the ejection mechanism 2 therein. The heart-shaped guiding slot 133 has a concave 136 facing to the receiving trough 131. A front end of a top of the partition 134 extends towards the receiving space 15 to form a resisting portion 135 spaced from the bottom wall 11.

Figure 4:
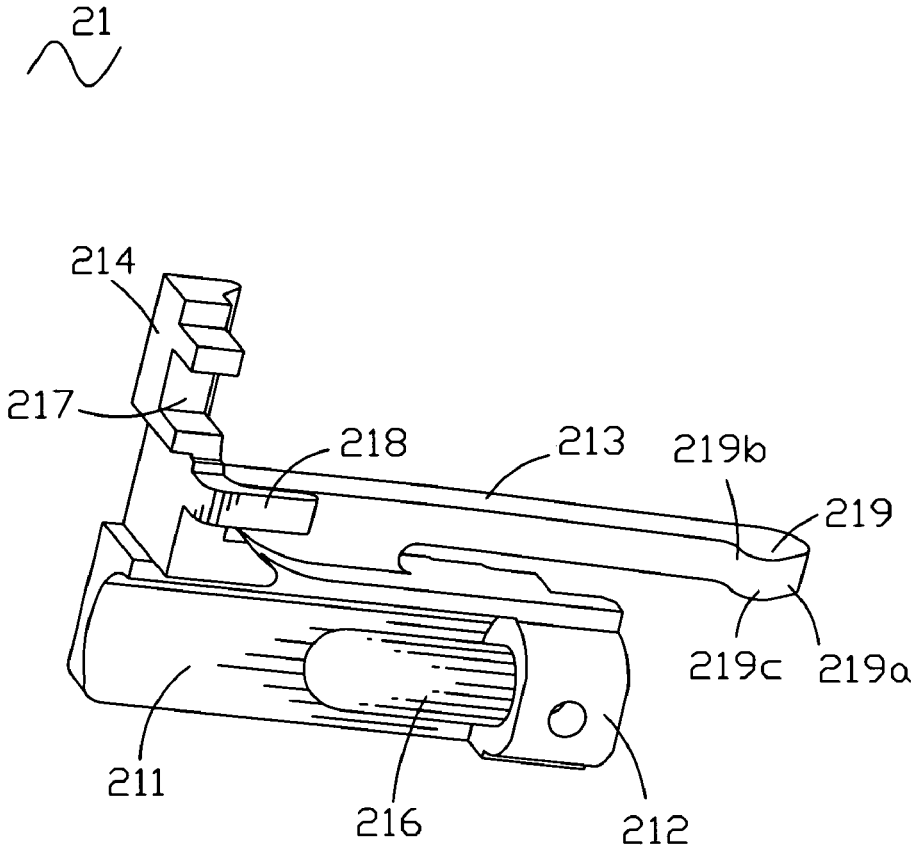
FIG. 4 shows a perspective view of a slider of an ejection mechanism of the memory card connector.

The ejection mechanism 2 includes a slider 21, a guide pin 22 and an elastic element 23. As best shown in FIG. 4, the slider 21 has a base body 211 having an arched bottom surface, a pushing body 212 projecting downward from a front of the base body 211, a sliding body 214 extending transversely from a rear of the base body 211, and an elongated locking body 213 extending frontward from a root portion of the sliding body 214 and exceeding the front of the base body 211. The base body 211 defines an insertion hole 215 penetrating through the pushing body 212. A location pillar 216 protrudes rearward from a rear of the pushing body 212 and is located below the arched bottom surface of the base body 211. The sliding body 214 defines an opening 217 at a lower portion thereof and away from the base body 211. A sliding arm 218 extends forward from a bottom end of sliding body 214 to be substantially parallel to the locking body 213. A free end of the locking body 213 is projected downwardly to form a projection 219 showing a substantially inverted triangle shape. The projection 219 has an inclined front surface 219*a*, an inclined rear surface 219*b* and a sharp corner 219*c* smoothly connecting the inclined front surface 219*a* and the inclined rear surface 219*b* together.

In assembly of the ejection mechanism 2, the slider 21 is received in the receiving trough 131 with the pushing body 212 located in a front end of the receiving trough 131. The arched bottom surface of the base body 211 is coupled with the receiving trough 131 for receiving the elastic element 23 therein. One end of the elastic element 23 encircles the holding pillar 132 and is against the rear surface of the receiving trough 131, while the other end encircles the location pillar 216 and is against the pushing body 212. The locking body 213 extends into the receiving space 15 and is spaced from the bottom wall 11 to define a sliding passage 101 (see FIG. 5) therebetween. The sliding body 214 is placed on the bottom wall 11 with the opening 217 communicated with one of the terminal grooves 111 and the sliding arm 218 slidably received in the through slot 112. One end of the guide pin 22 is inserted into the insertion hole 215 and the other end is slidably received in the heart-shaped guiding slot 133.

Each of the terminals 30 has a fixed portion 31, a soldered portion 32 and a contact portion 33 respectively extending opposite to each other from two opposite ends of the fixed portion 31. The terminals 30 are received in the corresponding terminal grooves 111 of the insulating housing 10. The soldered portions 32 are exposed out of the bottom wall 11 for being soldered to a PCB (not shown). The contact portions 33 project out of the terminal grooves 111 for electrically connecting with the memory card 200. The contact portion 33 of one of the terminals 30 further passes through the opening 217 of the sliding body 214.

The shielding shell 4 has a top plate 41, two opposite first and second side plates 42, 43, and a rear plate 44 respectively extending downwardly from the top plate 41. The top plate 41 is covered on the insulating housing 10 and defines a pressing tab 411 at a front portion thereof and adjacent to the second side plate 43. The pressing tab 411 slants downwardly to press against the guide pin 22 for preventing the guide pin 22 releasing out of the heart-shaped guiding slot 133. Adjacent to the pressing tab 411, an elastic piece 412 is punched at the top plate 41 and covered on the locking body 213. The first side plate 42 defines an engaging piece 421 at a rear end thereof for being engaged with the notch 121 of the rear wall 12 correspondingly. The second side plate 43 and the rear plate 44 are respectively attached to the outside of the sidewall 13 and the rear wall 12, and both of them define two fixing holes 45 for being engaged with the corresponding protruding lumps 14. The first side plate 42, the second side plate 43 and the rear plate 44 both define at least one propping piece 46 bent inwardly to be attached to the bottom wall 11.

Figure 6:
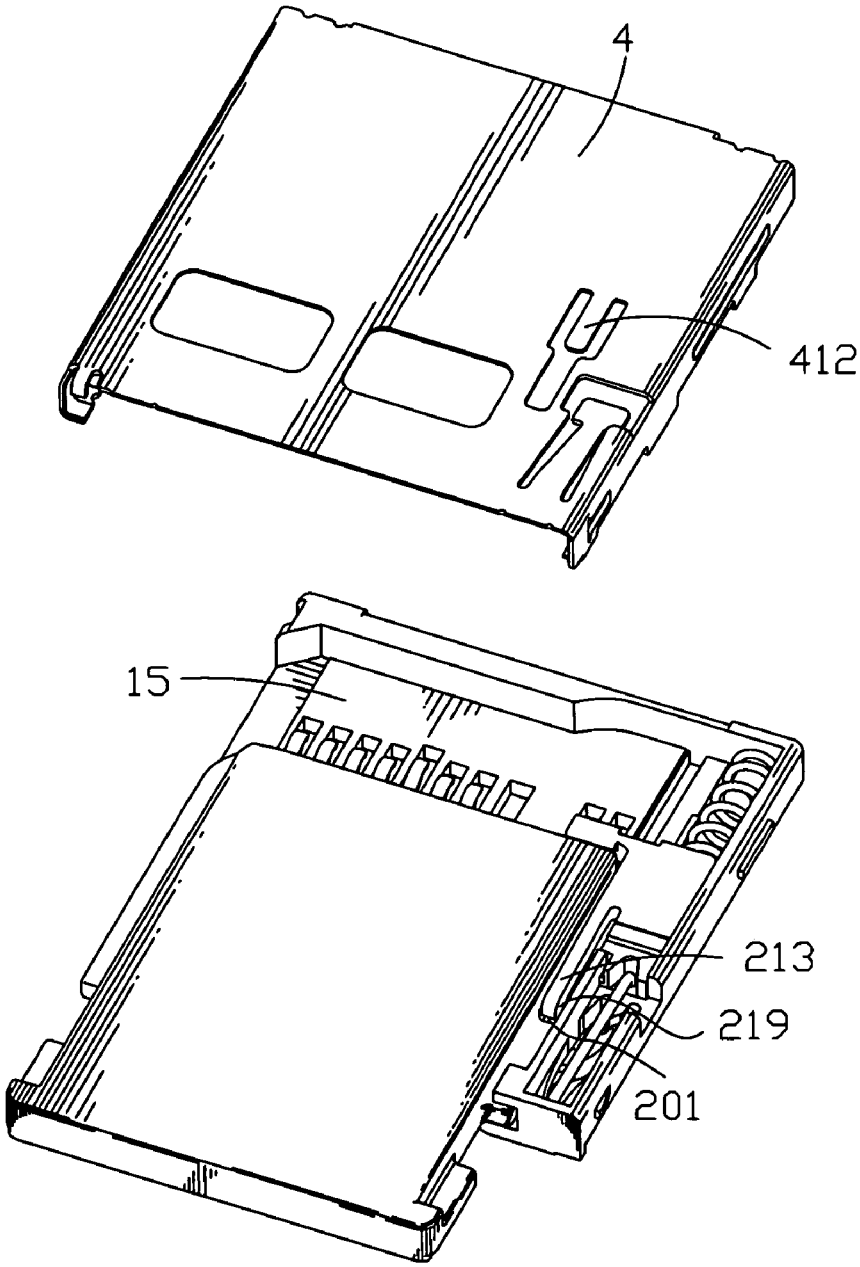
FIG. 6 is a partially assembly view of FIG. 5 during insertion of the memory card.

Referring to FIG. 5 and FIG. 6, the memory card 200 is inserted into the memory card connector 100 by means of sliding in the sliding passages 101 to enter the receiving space 15. One side of the memory card 200 slides rearward along the sliding passage 101 and touches the inclined front surface 219*a* of the projection 219 to push the locking body 213 up, then the locking body 213 pushes up the elastic piece 412 of the shielding shell 4. The memory card 200 is further inserted into the memory card connector 100, while the projection 219 is buckled into a recess 201 formed at the side of the memory card 200, the locking body 213 is depressed by the elastic piece 412 to press on the side of the memory card 200, thus, the memory card 200 is locked firmly. Then, the memory card 200 pushes the sliding body 214 to make the sliding arm 218 slide rearward along the through slot 112. The pushing body 212 is driven to compress the elastic element 23 and pull the guide pin 22 to slide rearwards along the heart-shaped guiding slot 133. When the end of the guide pin 22 slides into the concave 136 of the heart-shaped guiding slot 133, the memory card 200 is fully received in the receiving space 15. In this case, the resisting portion 135 tightly presses against the memory card 200 for further fixing the memory card 200 to the memory card connector 100.

The memory card 200 is to be ejected from the memory card connector 100, a user may push the memory card 200 again to make the guide pin 22 slip out of the concave 136 of the heart-shaped guiding slot 133. Then the compressed elastic element 23 is released and urges the pushing body 212 to slide forwardly, meanwhile, the sliding body 214 is driven to slide forward so as to push the memory card 200 to move forwardly. While the guide pin 22 returns to original position of the heart-shaped guiding slot 133, the locking body 213 presses on the side of the memory card 200 and the projection 219 of the locking body 213 is still engaged with the recess 201, which stops the memory card 200 moving on forwardly. In this case, the memory card 200 is partially received in the memory card connector 100. The user may draw the memory card 200 to move to the inclined rear surface 219*b* of the projection 219 and force the projection 219 to slip out of the recess 201, and therefore, the locking body 213 is pushed up. Then the memory card 200 is drawn out of the memory card connector 100 smoothly.

As the above description, when the memory card 200 is inserted into the memory card connector 100, the locking body 213 presses on the side of the memory card 200 and the projection 219 is buckled into the recess 201 of the memory card 200, which locks the memory card 200 to the memory card connector 100 firmly. When the memory card 200 is ejected from the memory card connector 100, the projection 219 is engaged with the recess 201 to retain the memory card 200 partially in the memory card connector 100, which prevents the memory card 200 from being overly ejected and falling to the ground.

What is claimed is:

1. A memory card connector adapted for receiving a memory card, comprising:

an insulating housing defining a receiving space for receiving the memory card and a plurality of terminal grooves;

a plurality of terminals received in the corresponding terminal grooves;

an ejection mechanism mounted to a side of the insulating housing, the ejection mechanism having a slider, the slider having a base body, a sliding body extending inward from a rear of the base body to be located in the receiving space, and an elongated locking body extending frontward from a root portion of the sliding body and spaced from a bottom wall of the insulating housing, a free end of the locking body projected downward to form a projection for being buckled into a recess formed at a side of the memory card; and a shielding shell mated with the insulating housing, the shielding shell having a top plate covered on the insulating housing, the top plate having an elastic piece formed therein and overlaying the locking body for providing a pressure to the locking body while the locking body is being pushed up.

2. The memory card connector as claimed in claim 1, wherein the projection is formed as a substantially inverted triangle shape, the projection has an inclined front surface, an inclined rear surface and a corner smoothly connecting the inclined front surface and the inclined rear surface together.

3. The memory card connector as claimed in claim 1, wherein the ejection mechanism is push-push type.

* * * * *